US007278838B2

(12) United States Patent
Hodson

(10) Patent No.: US 7,278,838 B2
(45) Date of Patent: Oct. 9, 2007

(54) INLET CHECK VALVE WITH REMOVABLE SEAT

(75) Inventor: S. Matthew Hodson, Joplin, MO (US)

(73) Assignee: Waterjet Service, Inc., Joplin, MO (US)

( * ) Notice: Subject to any disclaimer, the term of this patent is extended or adjusted under 35 U.S.C. 154(b) by 536 days.

(21) Appl. No.: 10/868,307

(22) Filed: Jun. 15, 2004

(65) Prior Publication Data

US 2005/0276712 A1 Dec. 15, 2005

(51) Int. Cl.
*F04B 39/10* (2006.01)
*F04B 53/10* (2006.01)

(52) U.S. Cl. ..... 417/569; 417/51

(58) Field of Classification Search ..... 417/571, 417/559, 569

See application file for complete search history.

(56) References Cited

U.S. PATENT DOCUMENTS

| | | | | |
|---|---|---|---|---|
| 625,114 | A | | 5/1899 | MacSpadden |
| 1,116,467 | A | | 11/1914 | Myers |
| 1,165,100 | A | | 12/1915 | Holland |
| 1,539,127 | A | | 5/1925 | Lipman |
| 1,608,424 | A | | 11/1926 | Putnam |
| 1,700,234 | A | | 1/1929 | McCrosky |
| 1,785,313 | A | | 12/1930 | Keener |
| 1,796,455 | A | | 3/1931 | Gunn et al. |
| 2,001,885 | A | | 5/1935 | Ohmart |
| 2,043,849 | A | | 6/1936 | Bixler |
| 2,048,943 | A | | 7/1936 | Munn |
| 2,061,480 | A | | 11/1936 | Pigott |
| 2,118,356 | A | | 5/1938 | Money |
| 2,143,399 | A | | 1/1939 | Abercrombie |
| 2,217,380 | A | | 10/1940 | Pedder et al. |
| 2,264,136 | A | * | 11/1941 | Karlberg ..... 137/535 |
| 2,268,119 | A | | 12/1941 | Honstetter et al. |
| 2,296,135 | A | | 9/1942 | Batson et al. |
| 2,353,161 | A | | 7/1944 | Heigis et al. |
| 2,725,183 | A | | 11/1955 | Hanson |
| 2,996,155 | A | | 8/1961 | Priesemuth |
| 3,060,961 | A | | 10/1962 | Conley |
| 3,106,169 | A | | 10/1963 | Prosser et al. |
| 3,123,867 | A | | 3/1964 | Combs |
| 3,260,217 | A | | 7/1966 | Thresher |
| 3,309,013 | A | | 3/1967 | Bauer |
| 3,309,014 | A | | 3/1967 | Bauer et al. |
| 3,503,079 | A | | 3/1970 | Smith |
| 3,526,246 | A | | 9/1970 | Leitgeb |
| 3,544,065 | A | * | 12/1970 | Mercier ..... 251/284 |
| 3,659,967 | A | | 5/1972 | McArthur et al. |
| 3,765,306 | A | | 10/1973 | Luft |
| 4,026,322 | A | | 5/1977 | Thomas |
| 4,098,085 | A | | 7/1978 | McDowell |

(Continued)

*Primary Examiner*—William H. Rodriguez
(74) *Attorney, Agent, or Firm*—Wood, Herron & Evans, L.L.P.

(57) ABSTRACT

An inlet check valve is mountable to a valve body that, in turn, is mounted to a high pressure pump. The inlet check valve has a removable inlet seat with a first through-hole forming an inlet path and functioning as a valve seat. A valve is positionable over the first through-hole. An inlet guide has first, second, third and fourth through-holes alignable with respective first, second, third and fourth through-holes of the inlet seat. The third and fourth through-holes receive fasteners to mount the inlet check valve to the valve body.

16 Claims, 1 Drawing Sheet

U.S. PATENT DOCUMENTS

| | | | | |
|---|---|---|---|---|
| 4,371,001 | A | | 2/1983 | Olsen |
| 4,501,292 | A | | 2/1985 | Maloblocki |
| 4,624,176 | A | | 11/1986 | Steinke |
| 5,037,276 | A | | 8/1991 | Tremoulet, Jr. |
| 5,037,277 | A | | 8/1991 | Tan |
| 5,226,799 | A | | 7/1993 | Raghavan et al. |
| 5,337,561 | A | | 8/1994 | Raghavan et al. |
| 5,381,631 | A | | 1/1995 | Raghavan et al. |
| 5,564,469 | A | | 10/1996 | Tremoulet, Jr. et al. |
| 5,709,242 | A | | 1/1998 | Bergen |
| 5,904,179 | A | * | 5/1999 | Gaillard et al. ..... 137/533 |
| 6,021,810 | A | * | 2/2000 | Gaillard et al. ..... 137/533 |
| 2005/0249620 | A1 | * | 11/2005 | Agrawal et al. ..... 417/559 |

* cited by examiner

INLET CHECK VALVE WITH REMOVABLE SEAT

FIELD OF THE INVENTION

This invention relates generally to the field of check valves and, more particularly, to an improved inlet check valve for use with a high pressure waterjet intensifier.

BACKGROUND OF THE INVENTION

A waterjet intensifier has a high pressure cylinder of, for example, up to 40,000 psi or greater; and fluid to the high pressure cylinder is supplied via an inlet check valve that also must be capable of operating reliably at such high pressures. One example of an inlet check valve assembly is described in U.S. Pat. No. 6,021,810, which discloses an inlet valve mounted on the end of a projecting portion of a generally cylindrical check valve body. The inlet check valve has a ball valve element that is mounted over an inlet passage. Such a check valve functions well in service, however, the design does have an opportunity for an improvement. The valve body is made of a steel material that is not as hard as the ball valve. After some time in service, the repetitive action of the ball valve being pushed against the valve body seat by the high pressure liquid results in wear on the valve body where the ball valve seats. After continued use, the inlet check valve should be serviced, which requires that the valve body be machined or replaced to restore a high quality inlet valve seat. Such a servicing process is costly and labor intensive. Consequently, there is the need for an improved inlet check valve that has a longer useful life.

SUMMARY OF THE INVENTION

The present invention provides an inlet check valve that provides a long, highly reliable service life. In addition, the inlet check valve of the present invention isolates all wear parts; and while such isolation requires extra static seals, additional sealing components are not required, which would otherwise reduce the service life of the inlet check valve. Further, the inlet check valve of the present invention permits all wear parts to be easily and quickly replaced in the field, thereby substantially reducing the cost of servicing the inlet check valve. Thus, the inlet check valve of the present invention is especially useful in high pressure cylinders that require a long service life.

In accordance with the principles of the present invention and in accordance with the described embodiments, the present invention provides an inlet check valve mounted with first and second fasteners to an end surface of a projection extending from one end of a valve body. The valve body has inlet and outlet passages intersecting the projection end surface, and the valve body is mounted to a high pressure pump for conducting a low pressure liquid via the inlet passage to the high pressure pump and conducting a high pressure liquid via the outlet passage from the high pressure pump. The inlet check valve has an inlet seat with first and second through-holes locatable adjacent the inlet passage and the outlet passage, respectively, and third and fourth through-holes receiving the first and second fasteners, respectively. A first surface on the inlet seat is locatable against the projection end surface and forms a liquid tight seal therewith.

A valve is positionable over the first through-hole to define a closed valve position blocking a flow of liquid past the valve and through the inlet passage. An inlet guide has first and second through-holes alignable with respective first and second through-holes of the inlet seat. Third and fourth through-holes of the inlet guide are locatable adjacent the third and fourth through-holes of the inlet seat, respectively, and also receive the first and second fasteners, respectively. A cavity in the inlet guide is aligned with the first through-hole of the inlet seat and maintains the valve between the cavity and the first through-hole of the inlet seat. The valve is positionable in the cavity away from the closed valve position to define an open valve position permitting the flow of liquid past the valve and through the inlet passage.

In one aspect of the invention, the end surface and the first surface are lapped surfaces. In another aspect of the invention, an alignment component extends into the inlet seat, the end surface and the inlet guide for aligning the inlet guide and the inlet seat with the end surface.

These and other objects and advantages of the present invention will become more readily apparent during the following detailed description together with the drawings herein.

DETAILED DESCRIPTION OF THE INVENTION

Figure 1:
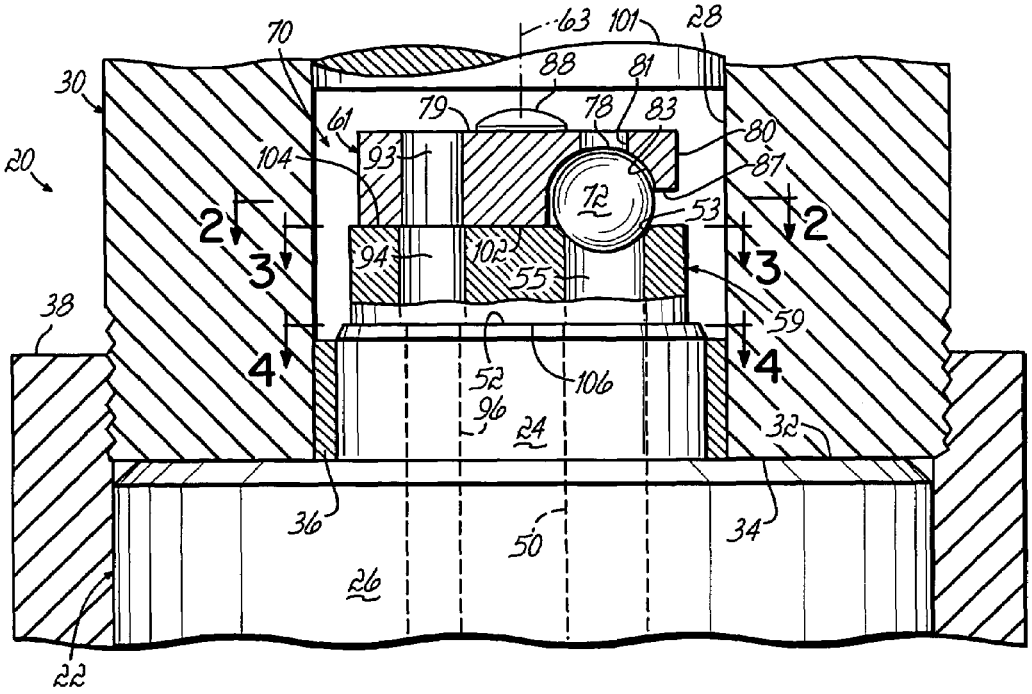
FIG. 1 is a side elevation view partially in cross-section of a portion of a check valve body illustrating a valve element of an inlet check valve in its closed position in accordance with the principles of the present invention.

Referring to FIG. 1, a check valve assembly 20 of the present invention includes a generally cylindrical check valve body 22. The check valve body 22 has a centrally located cylindrical projection 24 that extends beyond a larger diameter flange 26 into the bore 28 of a high pressure hydraulic cylinder or pump 30. The flange 26 has an annular surface 32 that bears against an end surface 34 of the cylinder 30. An annular seal 36 fills the gap between the outer surface of the projection 24 and the inner surface of the bore 28. The check valve body 22 is secured to the end of a high pressure hydraulic cylinder 30 by means of an end cap 38 screwed onto the cylinder 30 in a known manner.

Figure 2:
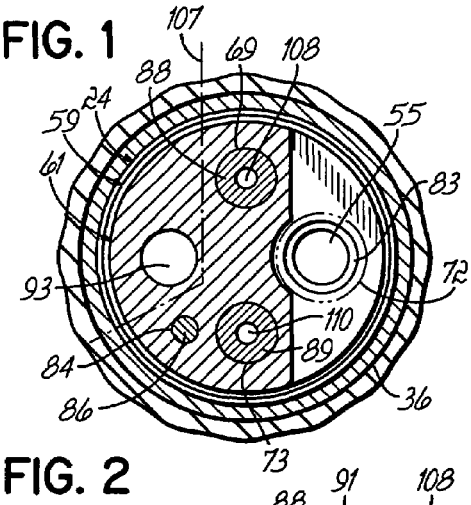
FIG. 2 is cross-sectional top view of the inlet check valve taken generally along line 2-2 of FIG. 1.

Referring to FIGS. 1 and 2, an inlet check valve 70 is mounted on the end surface 52 of the projection 24. The inlet check valve 70 includes a valve 72 having an outer surface with a curved or spherical shape and cross-sectional profile. The valve 72 is often a ball disposed above an inlet 53 formed at one end of a fluid inlet path 55 within an inlet seat 59. The inlet fluid path 55 intersects an off-center, low pressure fluid inlet passage 50 on an end surface 52 on the end of the projection 24, and the inlet fluid passage 50 is fluidly connected with a source of low pressure fluid (not shown) in a known manner.

Above the valve 72 is a cavity 83 of an inlet guide 61. The inlet guide 61 has an upper side or surface 79 with an arcuate or circular periphery extending approximately parallel to the surface 52 of the projection 24. A portion of the upper side 79 forms a flange 80, and an opening or hole 81 is located in the flange 80. The cavity 83 is disposed in an inner or a lower side 87 of the inlet guide flange 80. The cavity 83 has a curved and preferably spherical shape and cross-sectional profile. Thus, the valve 72 is able to move freely in the cavity 83 and in a direction generally parallel to a centerline 63 of the valve body 22. The displacement or lift of the valve 72 is fixed by the height of the cavity 83 above the end surface 52 and the size of the valve 72, for example, the diameter of the valve 72. The hole 81 is radially displaced from the centerline 63 of the valve body 22 and is concentric with the fluid inlet path 55 in the inlet seat 59, which, in turn, is concentric with, and intersects, the valve body fluid inlet passage 50.

Figure 3:
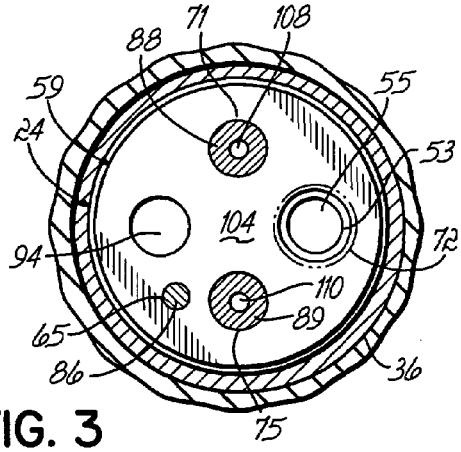
FIG. 3 is cross-sectional top view of the inlet check valve taken generally along line 3-3 of FIG. 1.
Figure 4:
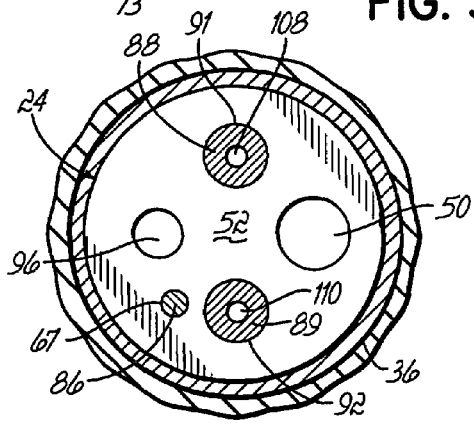
FIG. 4 is cross-sectional top view of the inlet check valve taken generally along line 4-4 of FIG. 1.

Referring to FIGS. 1 and 3, in this embodiment, an alignment or locating pin 86 is press fit into hole 65 of the inlet seat 59 and extends beyond an upper surface 104 and lower surface 106. Referring to FIG. 2, the inlet guide 61 has a first alignment or locating element 84, for example, a locating hole, sized to receive the locating pin 86. As shown in FIG. 4, the locating pin 86 extends into a second alignment or locating element 67, for example, a locating hole in the projection surface 52. The locating holes 84, 67 and locating pin 86 provide a first mechanism for locating the inlet guide 61 and the inlet seat 59 with respect to the valve body 22, so that the fluid inlet passage 50 and the fluid inlet path 55 can be properly aligned.

Referring to FIGS. 2-4, first clearance holes 69, 71 extend through the inlet guide 61 and inlet seat 59, respectively; and second clearance holes 73, 75 also pass through the inlet guide 61 and inlet seat 59, respectively. A first fastener 88, for example, a machine screw, passes through the first clearance holes 69, 71 and engages with a threaded hole 91 (FIG. 4) in the surface 52 of the projection 24. A second fastener 89, for example, a machine screw, passes through the second clearance holes 73, 75 and engages with a threaded hole 92 also in the surface 52 of the projection 24. Thus, the clearance holes 69, 71, 73, 75, threaded holes 91, 92 and fasteners 88, 89 provide a second mechanism for properly aligning the inlet guide 61 and inlet seat 59 with the valve body projection 24. The fasteners 88, 89 also securely fix the position of the inlet guide 61 and inlet seat 59 with respect to valve body projection 24 to maintain the valve 72 centrally over the fluid inlet path 55 and fluid inlet passage 50.

The inlet guide 61 further includes an off-center, high pressure fluid outlet path 93 that is concentrically alignable with a fluid outlet bore 94 in the inlet seat 59, which, in turn, is concentrically alignable with an outlet fluid passage 96 within the valve body 22. The outlet fluid passage 96 provides a fluid exit from the valve body 22 in a known manner via an outlet check valve (not shown).

The valve body projection surface 52 and its opposing surface 106 on the inlet seat 59 are made with a lapped finish. Therefore, lapped surfaces 52, 106, when brought together, form a liquid-tight static seal around the fluid outlet bore 94 and the outlet fluid passage 96. Thus, even though the addition of the inlet seat 59 increases the number of static seals required, such static seal is provided by the contacting lapped surfaces 52, 106 without the use of separate sealing components, for example, O-rings.

In use, referring to FIG. 1, during an intake stroke, a piston 101 within the cylinder 30 moves away from the projection 24, thereby creating a pressure differential across the inlet check valve 70 such that the fluid in the inlet fluid passage 50 and the inlet fluid path 55 are under a relatively small positive pressure. That positive fluid pressure is applied against the outer surface of the valve 72 and pushes the valve 72 away from the end surface 52 of the projection 24 and the closed position illustrated in FIG. 1 to an open position. When in the open position, fluid readily flows from the fluid source (not shown) through the inlet fluid passage 50 and the inlet fluid path 55 to fill the bore 28 of the cylinder 30. When the piston 101 in the cylinder 30 reverses direction, a very high fluid pressure is applied via the opening 81 to an upper portion 78 of the outer surface (as viewed in FIG. 1) of the valve 72, thereby creating a pressure differential. That pressure differential pushes the valve 72 to a closed position in which the outer surface of the valve 72 partially extends past the end surface 104 and seats itself in the inlet orifice 53 of the inlet seat 59, thereby sealing the inlet orifice 53 as illustrated in FIG. 1. In the sealing position, the valve 72 has an annular area, that is, a thin circular line, of bearing contact with an annular portion of the orifice 53. Thus, fluid is prevented from passing through the inlet 53 into the inlet fluid path 55. The high pressure fluid passes through the outlet fluid path 93 in the inlet guide 61, the outlet bore 94 in the inlet seat 59 and through the outlet passage 96. During the operation of the cylinder pump 30, it is believed that the valve 72 continuously rotates, to some extent, to provide a different outer surface area against the annular sealing area around the inlet 53. Therefore, the valve 72 wears evenly during use, is less subject to overheating and provides a highly repeatable fill cycle.

The operation of the valve described herein provides superior performance. It is believed that the curved shape of the outer surface of the valve 72 provides less resistance in the closing process; and therefore, the valve 72 is more responsive and closes faster than other valves. Normally, the piston 101 is powered by a reciprocating pump which creates significant pressure spikes in reversing direction. An accumulator is used to absorb the changes in pressure, but the hydraulic system still experiences pressure spikes. The faster response of the valve 72 minimizes those pressure spikes and provides a generally improved and smoother operation.

The inlet seat 59 is made from a hard stainless steel, for example, a 0.812ø 15-5 PH H900 stainless steel, which is harder than the material used to make the valve body 22. The inlet guide 61 is also made from a stainless steel, for example, a 300 series stainless steel. With such materials, the inlet 53 provides a valve seat that has a substantially longer service life than valve seats located in the end surface 52 of the projection 24 as is done in comparable known valves.

However, when it is desired to service the inlet check valve 70, the end cap 38 is unscrewed from the end 40 of the cylinder 30; and the valve body 22 is removed from the end of the cylinder 30. Removing the screws 88, 89 releases the inlet guide 61, valve 72 and inlet seat 59 from the valve body projection 24. A new inlet valve seat 59 is installed by inserting the locating pin 86 extending from the surface 106 into the locating hole 67 of the valve body projection 24. A new valve 72 is placed on the inlet 53, and the locating hole 84 in the inlet guide 61 is placed over the locating pin 86 extending from the surface 104 of the inlet seat 59. The screws 88, 89 are inserted through respective clearance holes 69, 71, 73, 75 and into respective threaded holes 91, 92. The curved or spherical shape of the outer surface of the valve 72 automatically aligns the valve 72 in its desired concentric position with respect to the inlet 53, and the screws 88, 89 are tightened to complete assembly of the check valve 70. Further, if the screws 88, 89 are not fully tightened or loosen during operation, the valve 72 cannot move but maintains its desired concentric relationship with the inlet 53.

The inlet check valve 70 described herein has several advantages. First, the use of the harder inlet seat 59 provides the inlet check valve 70 with a substantially longer service life than comparable known valves. Second, the additional static seals required by the inlet seat 59 are achieved without requiring separate sealing components such as O-rings, which also contributes to the increased service life of the inlet check valve 70. Third, the valve 72 and inlet seat 59 are not permanently connected to any other components and therefore, can be individually replaced, thereby substantially reducing the cost of servicing the inlet check valve 70. Thus, the inlet check valve 70 provides a long, highly reliable operation, can be easily and quickly serviced in the field and is especially adaptable for use in high pressure cylinders.

While the invention has been set forth by a description of the preferred embodiment in considerable detail, it is not intended to restrict or in any way limit the claims to such detail. Additional advantages and modifications will readily appear to those who are skilled in the art. For example, while the cavity 83 is shown as being a mating partial spherical shape, the cavity may be conical or any other shape that is effective to receive and maintain a valve in its desired operating position with respect to the inlet 53. Further, in the disclosed embodiment, the valve 72 is spherical; however, as will be appreciated, the valve can be any shape that can be held captured by the cavity 83 and provides a circular line of contact with the inlet 53 when the valve is in the closed position. For example, the valve could be conical in shape, have a bull nose shape or be curved but not spherical. As will be appreciated, in an alternative embodiment, the valve 72 can be a poppet that covers the inlet fluid path 55. In addition, the orifice illustrated as being the opening 81 is shown as a single cylindrical hole; however, an opening or openings of any size, shape and number may be used to facilitate the application of a closing pressure force onto the valve 72.

As will be appreciated, the locations of one or both of the locating holes 84, 67 and the locating pin 86 may be reversed such that the locating hole extends through the inlet valve seat 59 and locating pins are attached to the inlet guide 61 and projection 24, respectively. Further, in the disclosed embodiment, the major cross-sectional profile of the inlet guide 61, that is, the cross-sectional profile taken right below the upper surface 79, is generally arcuate and specifically circular. However, the inlet guide 61 may have a noncircular shape such that the major cross-sectional profile is octagonal, hexagonal or an irregular shape. Further, it is not required that the inlet guide 61 and inlet seat 59 cover the outlet fluid passage 96. For example, an inlet guide 61 may be made that eliminates the portion of the mounting plate shown to the left of the phantom line 107 in FIG. 2. In the described embodiment, the screws 88, 89 have respective pressure relieving bores 108, 110.

Therefore, the invention in its broadest aspects is not limited to the specific detail shown and described. Consequently, departures may be made from the details described herein without departing from the spirit and scope of the claims which follow.

What is claimed is:

1. An inlet check valve mounted with a first fastener to an end surface of a projection extending from one end of a valve body, the valve body having an inlet passage and an outlet passage intersecting the end surface of the projection, the valve body being mounted to a high pressure pump for conducting a low pressure liquid via the inlet passage to the high pressure pump and conducting a high pressure liquid via the outlet passage from the high pressure pump, the inlet check valve comprising:

an inlet seat adapted to be sealingly located on, and removable from, the end surface of the projection, the inlet seat comprising first and second through-holes adapted to be disposed adjacent the inlet passage and the outlet passage, respectively, a third through-hole adapted to receive the first fastener, and a first surface adapted to be disposed against the end surface of the projection and forming a liquid tight seal therewith;

a valve positionable over the first through-hole of the inlet seat to define a closed valve position blocking a flow of liquid past the valve and through the inlet passage; and an inlet guide comprising first and second through-holes alignable with the respective first and second through-holes of the inlet seat, a third through-hole positionable adjacent the third through-hole of the inlet seat, and adapted to receive the first fastener, and a cavity aligned with the first through-hole of the inlet seat for receiving and maintaining the valve between the cavity and the first through-hole of the inlet seat, the valve being positionable in the cavity and away from the closed valve position to define an open valve position permitting the flow of liquid past the valve and through the inlet passage.

2. The inlet check valve of claim 1 wherein the end surface and the first surface form a liquid-tight static seal without using a separate sealing component.

3. The inlet check valve of claim 2 wherein the inlet check valve is mounted with a second fastener to the end surface, and the inlet check valve further comprises:

a fourth through-hole in the inlet seat and adapted to receive the second fastener; and a fourth through-hole in the inlet guide positionable adjacent the fourth through-hole in the inlet seat and adapted to receive the second fastener.

4. The inlet check valve of claim 1 further comprising an alignment component extending from the inlet seat into the end surface of the projection and into the inlet guide for aligning the inlet seat with the inlet guide and the projection.

5. The inlet check valve of claim 1 wherein the inlet seat is made of a material harder than material used to make the end surface of the projection.

6. An inlet seat for use with an inlet check valve and mountable with a first fastener to, and subsequently removable from, an end surface of a projection extending from one end of a valve body, the valve body having an inlet passage and an outlet passage intersecting the end surface of the projection, the valve body being mounted to a high pressure pump for conducting a low pressure liquid via the inlet passage to the high pressure pump and conducting a high pressure liquid via the outlet passage from the high pressure pump, the inlet check valve comprising a valve, and an inlet guide comprising:

first and second through-holes, a third through-hole receiving the first fastener, and a cavity aligned with the first through-hole of the inlet guide for receiving and maintaining the valve, the inlet seat comprising:

a first surface adapted to be disposed against, and removable from, the end surface of the projection and the first surface forming a liquid tight seal with the end surface, a first through-hole adapted to be disposed between the inlet passage and the first through-hole of the inlet guide, the valve being positionable over the first through-hole in the first surface of the inlet seat to define a closed valve position blocking a flow of liquid past the valve and through the inlet passage;

a second through-hole adapted to be disposed between the outlet passage and the second through-hole in the inlet guide;

a third through-hole adapted to be positionable adjacent the third through-hole of the inlet guide and receive the first fastener.

7. The inlet seat of claim 6 wherein the end surface and the first surface form a liquid-tight static seal without using a separate sealing component.

8. The inlet seat of claim 7 wherein the inlet check valve is mounted with a second fastener to the end surface and the inlet guide has a fourth through-hole adapted to receive the second fastener, the inlet ball seat further comprising a fourth through-hole adapted to be positionable adjacent the fourth through-hole in the inlet guide and receive the second fastener.

9. The inlet seat of claim 7 further comprising an alignment component extending from the inlet seat into the end surface of the projection and into the inlet guide for aligning the inlet seat with the inlet guide and the projection.

10. The inlet seat of claim 7 wherein the inlet seat is made of a material harder than material used to make the end surface.

11. An inlet guide for use with an inlet check valve mounted with first and second fasteners to an inlet seat that, in turn, is mountable with the first and second fasteners to, and removable from, a projection extending from one end of a valve body, the valve body having an inlet passage and an outlet passage intersecting the end surface of the projection, the valve body being mounted to a high pressure pump for conducting a low pressure liquid via the inlet passage to the high pressure pump and conducting a high pressure liquid via the outlet passage from the high pressure pump, the inlet check valve comprising a valve positionable to block the inlet passage to define a closed valve position blocking a flow of liquid past the valve and through the inlet passage, the inlet guide comprising first and second through-holes adapted to be alignable with respective first and second through-holes of the inlet seat, which, in turn, are alignable with the inlet passage and the outlet passage, respectively;

third and fourth through-holes adapted to be alignable with respective third and fourth through-holes of the inlet seat and receive the first and second fasteners, respectively, and a cavity aligned with the first through-hole of the inlet guide and adapted to be alignable with the first through-hole of the inlet seat and the inlet passage and receive the valve, the valve being positionable in the cavity and away from the inlet passage to define an open valve position permitting the flow of liquid past the valve and through the inlet passage.

12. The inlet guide of claim 11 further comprising a locating hole adapted to receive a locating element for aligning the inlet seat with the end surface of the projection.

13. A high pressure pump comprising:

a cylinder having a piston disposed therein;

a valve body mounted on one end of the cylinder and comprising an end surface extending into the cylinder, an inlet passage intersecting the end surface and conducting a low pressure liquid to the cylinder, and an outlet passage intersecting the end surface and conducting a high pressure liquid away from the cylinder;

first and second fasteners securable to the end surface; and an inlet check valve mounted with first and second fasteners to the end surface, the inlet check valve comprising an inlet seat sealingly located on, and removable from, the end surface of the projection, the inlet seat comprising first and second through-holes adapted to be disposed adjacent the inlet passage and the outlet passage, respectively, third and fourth through-holes receiving first and second fasteners, respectively, and a first surface adapted to be disposed against the end surface of the projection and forming a liquid tight seal therewith, a valve positionable over the first through-hole in the first surface of the inlet seat to define a closed valve position blocking a flow of liquid past the valve and through the inlet passage, and an inlet guide comprising first and second through-holes alignable with the respective first and second through-holes of the inlet seat, third and fourth through-holes disposed adjacent the third and fourth through-holes of the inlet seat, respectively, and receiving the first and second fasteners, respectively, and a cavity aligned with the first through-hole of the inlet seat for receiving and maintaining the valve between the cavity and the first through-hole of the inlet seat.

14. The high pressure pump of claim 13 wherein the end surface and the first surface form a liquid-tight static seal without using a separate sealing component.

15. The inlet seat of claim 14 further comprising an alignment component extending from the inlet seat into the end surface of the projection and into the inlet guide for aligning the inlet seat with the inlet guide and the projection.

16. The high pressure pump of claim 14 wherein the inlet seat is made of a material harder than material used to make the end surface.

* * * * *